US007461836B2

(12) United States Patent
Moring

(10) Patent No.: US 7,461,836 B2
(45) Date of Patent: Dec. 9, 2008

(54) APPARATUS AND METHOD FOR CREATING AN INSERT ON AN INLINE PRINTING PRESS

(76) Inventor: Kenneth E. Moring, 230 Panola Rd., Jackson, GA (US) 30233

( * ) Notice: Subject to any disclaimer, the term of this patent is extended or adjusted under 35 U.S.C. 154(b) by 0 days.

(21) Appl. No.: 11/502,645

(22) Filed: Aug. 11, 2006

(65) Prior Publication Data

US 2008/0036132 A1 Feb. 14, 2008

(51) Int. Cl.
*B65H 37/04* (2006.01)

(52) U.S. Cl. ..... 270/52.07; 270/8; 270/40; 270/41; 270/5.01; 270/5.02; 270/5.03

(58) Field of Classification Search ..... 270/8, 270/40, 41, 5.01, 5.02, 5.03, 52.07; 493/79, 493/131, 148, 254, 331
See application file for complete search history.

(56) References Cited

U.S. PATENT DOCUMENTS 3,808,768 A * 5/1974 Dobbs ..... 53/460
3,902,655 A * 9/1975 Huffman ..... 229/69
4,066,251 A * 1/1978 Johnsen ..... 270/37
4,117,800 A * 10/1978 Maus et al. ..... 118/694
4,420,148 A * 12/1983 Meadows ..... 270/41
4,474,566 A * 10/1984 Meadows et al. ..... 493/346
5,230,501 A * 7/1993 Melton ..... 270/41
5,348,278 A * 9/1994 Ring ..... 270/52.07
6,029,968 A * 2/2000 Honegger ..... 270/37
6,170,759 B1 * 1/2001 Meyer ..... 239/298
6,860,308 B2 * 3/2005 Archie et al. ..... 156/463

* cited by examiner

*Primary Examiner*—Gene O. Crawford
*Assistant Examiner*—Leslie A Nicholson, III
(74) *Attorney, Agent, or Firm*—Drinker Biddle & Reath LLP

(57) ABSTRACT

A method and apparatus for forming individual insert assemblies using an inline printing press comprising forming from a web at least one first ribbon defining an insert; forming from the web at least one second ribbon defining an advertising panel; applying repositionable or stick once glue to the advertising panel; and attaching the advertising panel to the advertising insert by the repositionable or stick once glue, thereby creating an insert having a removably attached advertising panel.

11 Claims, 4 Drawing Sheets

NOTE: FOLDER AND STACKER ARE OFF THE PLAN TO SHOW ANGLE BARS

TOP VIEW

APPARATUS AND METHOD FOR CREATING AN INSERT ON AN INLINE PRINTING PRESS

FIELD OF THE INVENTION

The present invention relates to an apparatus and method for creating an insert on an inline printing press. The insert includes an attached panel that is attractive and interactive and resistant to misalignment, folding, or creasing.

BACKGROUND OF THE INVENTION

Retail stores rely heavily on newspaper advertising inserts to increase customer traffic into their stores. Typically these inserts describe items that are on sale at a retail store, and may also include coupons for various items. These inserts are intended to both entice the customer to purchase items described in the insert and to make the customer aware of the type of items sold by a store.

Commonly used inserts are simply folded newsprint pieces that are uniform in size and shape and are often smaller than the newspaper in which they are being inserted. These inserts may also be printed on calendared, coated, or other types of paper, but inserts printed on these types of paper are also uniform in size and shape. These commonly used inserts are deficient in that they are uninteresting and fail to draw the potential customers' attention. This is particularly true because many newspapers contain several inserts, all of which look similar to a consumer.

Advertisers have tried to create inserts that are more attractive to consumers but these inserts have limitations that end up making them less attractive to consumers. For example, advertisers have tried to use inserts that include a folded "gate" at the front of the insert, which consists of an extended page that is folded over the front of the insert to make the insert more interesting. Advertisers have also tried to use inserts that have a smaller-sized ribbon wrapped around the insert to make the insert more attractive. Both folded gate inserts and the ribbon wrapped inserts are problematic because the folded gate or ribbon are prone to becoming misaligned, creased, or folded during the creation and processing of the inserts. For example, the folded gate or ribbon on an insert have been known to become misaligned, creased, or folded when the insert is stacked for later insertion into a newspaper. In addition, the folded gate or ribbon on an insert has been known to slip while it is being transported to the location where it is to be inserted into a newspaper and as a result becomes misaligned, creased, or folded. Finally, the gate or ribbon on an insert has been known to become misaligned, creased, or folded while the insert is being inserted into a newspaper or other primary piece. The misalignment, creasing, or folding of the folded gate or wrapped ribbon on an insert makes the insert very unattractive, greatly reducing its interest to the consumer.

Accordingly, it is desirable to create an insert that is more noticeable to the consumer, which increases the chances that the consumer will look at the insert and patronize the store that is advertising in the insert. Thus, it is desirable to create an attractive and interactive insert that is easier to transport and to properly place into a newspaper, which reduces the chances of the insert becoming misaligned, creased, or folded, thus increasing the chances that a consumer will look at the insert.

SUMMARY OF THE INVENTION

Accordingly, the present invention is directed to a method and apparatus for creating an advertising insert that substantially obviates one or more of the problems and disadvantages of the related art. The present invention advantageously provides a method and apparatus for an inline process to create an improved advertising insert that provides a noteworthy advantage when being considered next to a prior art advertising insert.

This advantage is realized, in one aspect of the invention, by a method for creating an advertising insert with a removable advertising panel. An inline printing web forms two ribbons. The first ribbon is used to define an advertising insert. The second ribbon is used to define an advertising panel. The advertising panel is fastened to the advertising insert using repositionable glue or "stick once" glue. An object of the present invention is to provide an attractive and interactive insert that can increase the chances of a consumer reading the insert.

Another object of the present invention is to provide an attractive and interactive insert that is more resistant to misalignment, folding, or creasing when it is processed or placed within a newspaper.

Another object of the present invention is to provide an attractive and interactive insert that includes removably attached promotional sections.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an insert having a removably attached advertising panel is created by an inline printing press.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to an embodiment of the present invention, example of which is illustrated in the accompanying drawings.

Figure 1:
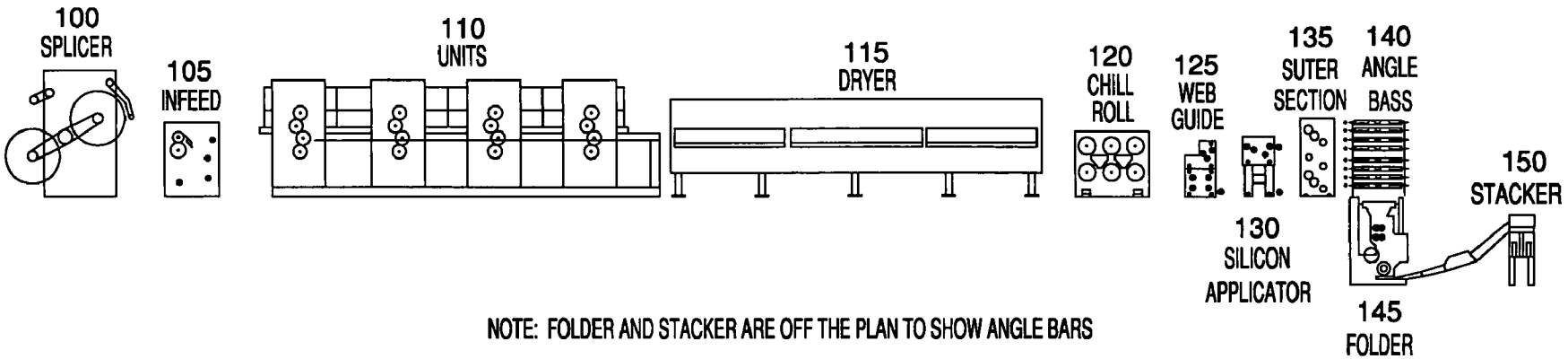
FIG. 1 shows a block diagram of an inline press of the present invention.
Figure 2:
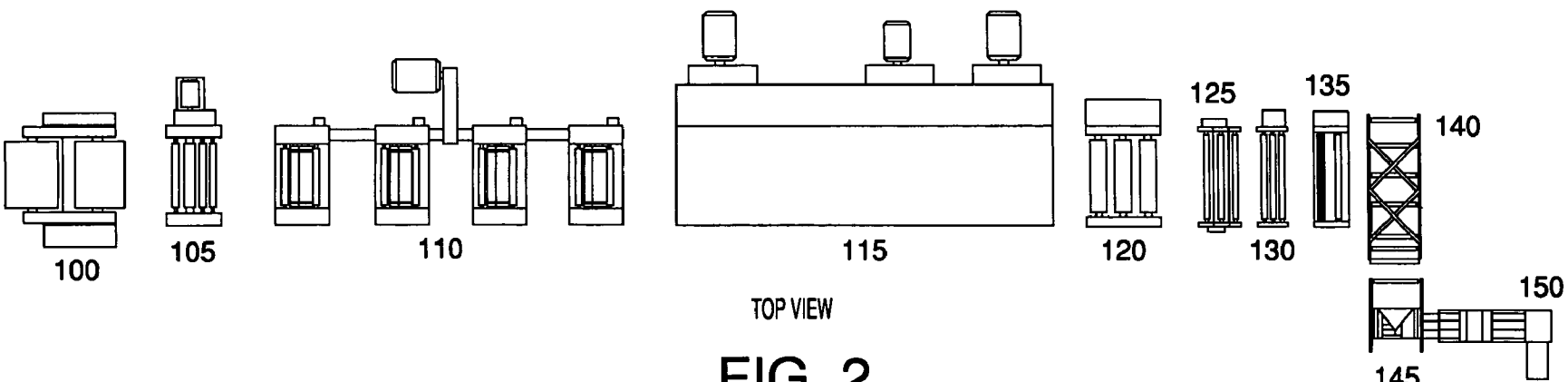
FIG. 2 shows a plan view block diagram of an inline press of the present invention.

FIGS. 1 and 2 show block diagrams of an inline printing press of the present invention. FIG. 1 shows a side view block diagram and FIG. 2 shows a plan view block diagram. The diagrams show a splicer 100 which supplies web material to the infeed 105. Inline printing press lines may have more than one splicer per line, and the splicer maintains a continuous feed of paper to the press by splicing a new web to the web being processed when the web being processed reaches the end of its roll.

The infeed 105 supplies the web to the printing units 110, controls the feeding of the web to the printing units, and may include tension control devices to control the tension in the web.

The printing units 110 may vary in number according to the number of colors desired on the web. The diagram of FIG. 1 shows 4 printing units in which each unit prints a different color, resulting in an insert having 4 colors. In addition, each printing unit typically includes upper and lower printing equipment for printing on both sides of the web.

After going through the printing units 110, the web typically then goes through a dryer unit 115. Typically the dryer unit 115 uses heat to remove the solvents and oils from the ink applied to the web by the printing units 110, leaving only the pigment and resin from the ink on the web. To set the pigment after it goes through the dryer unit 115, the web is typically then run through a chill roll unit 120. In one embodiment, these chill rollers have 65 degree water running through them which shocks the resin and sets the pigment to the web.

After the web leaves the chill roll unit 120, it then enters web guide 125. A web guide similar to web guide 125 may be used anywhere along the web to help maintain the proper direction of the web.

After the web leaves web guide 125, it enters silicon applicator 130. The silicon applicator 130 applies a thin film of silicone mixed with water to the web, which adds moisture that was removed by drying unit 115 back into the web.

At slitter apparatus 135, the web is cut into at least two ribbons. In one embodiment, one of the ribbons is used to create the insert, and one of the ribbons is used to create the advertising panel that is glued to the insert. In another embodiment, the slitter can be configured to slit the web into more than two ribbons, where one of the ribbons is used to create the insert and the remaining ribbons are used to create multiple advertising panels that are glued to the insert.

After slitter apparatus 135, the ribbons created by slitter apparatus 135 go through angle bars 140. The angle bars 140 are used to position the ribbons as needed for further processing. As shown in detail in FIG. 3, the angle bars cause the second ribbon (for an advertising panel) to be spaced apart from the first ribbon (for an advertising insert). A glue head is positioned in the space between the two ribbons and the glue head applies glue to the second ribbon (advertising panel). Then, the positioning of the angle bars causes the second ribbon (advertising panel) to be placed on top of the advertising insert, and the glue causes the advertising panel to be fastened to the insert, forming attached ribbons.

After the angle bars, the attached ribbons go through folder 145. Folder 145 includes a cutter that cuts the attached ribbons to create the individual inserts with an advertising panel. In one embodiment, the folder cuts the attached ribbons perpendicularly to the length of the web. After the cutter the individual inserts may be further folded by the folder 145. Stacker 150 receives the inserts (which may be folded) and stacks them. In one embodiment (not shown) the stacked individual advertising inserts are then transported to a location where they are then placed into newspapers, magazines, or other primary pieces.

Figure 3:
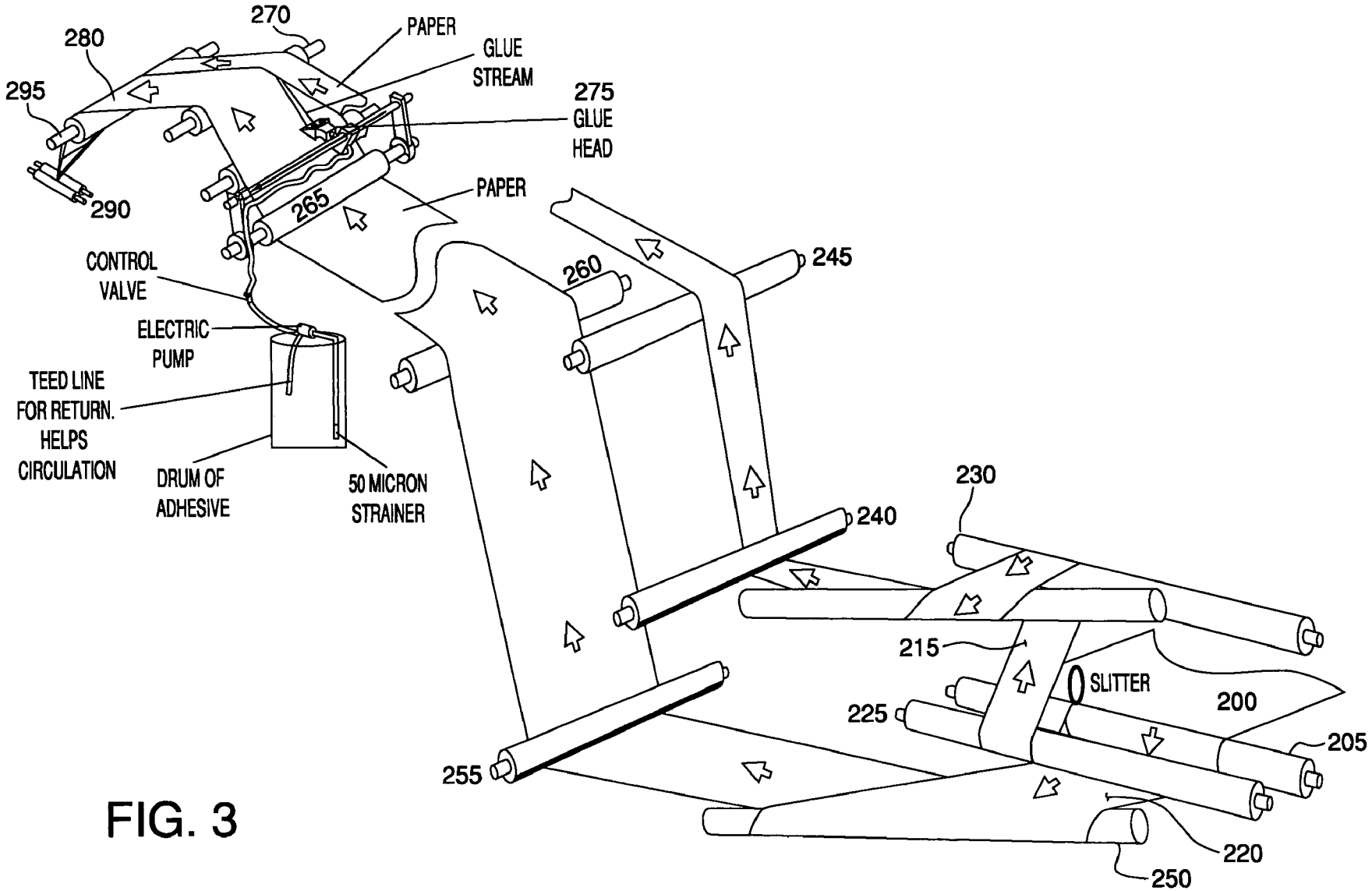
FIG. 3 shows a partial perspective view of the angle bars and folder used in the present invention.

FIG. 3 shows a detailed drawing of one embodiment of an inline press used to perform the invention. Specifically, FIG. 3 shows the inline press process from slitter apparatus 135 through the angle bars 140.

In FIG. 3, web 200 leaves silicon applicator 130 and enters slitter apparatus 135. Slitter apparatus 135 includes gain driven roller 205, which is used to ensure proper slitting of the web 200 by slitter 210. In one embodiment, gain driver roller 205 uses a 2% gain. The slit web 200 forms two separate ribbons, advertising panel ribbon 215 and advertising insert ribbon 220.

Advertising panel ribbon 215 and advertising insert ribbon 220 then enter angle bar apparatus 40 where they are positioned and attached using a series of idler rollers, former rollers, a former board, angle bars, and a glue head. In one embodiment, after slitter 210, advertising panel ribbon 215 wraps around idler roller 225 so that the ribbon is routed upwardly to idler roller 230. Advertising panel ribbon 215 then wraps around idler roller 230 so that it is routed fairly horizontally to angle bar 235. In this particular embodiment, a 45% angle is used on angle bar 235. Advertising panel ribbon 215 then wraps around angle bar 235, which causes the ribbon to change its direction 90 degrees in a horizontal plane towards idler roller 240. Advertising panel ribbon 215 then wraps around idler roller 240 so that the ribbon is routed upwardly to 245. Advertising panel ribbon 215 then wraps around idler roller 245 so that the ribbon is routed approximately horizontally to glue head 275.

While advertising panel ribbon 215 is process as described above, advertising insert ribbon 220 wraps around idler roller 205, then wraps around idler roller 225 so that the ribbon continues in an approximately horizontal plane. Then, advertising insert ribbon 220 is routed to 45% angle bar 250, which causes the ribbon to change its direction 90 degrees in a horizontal plane towards idler roller 255. Advertising insert ribbon 220 then wraps around idler roller 255 so that the ribbon is routed upwardly to idler roller 260. At idler roller 260, the advertising insert ribbon wraps around roller 260 so that the ribbon is routed approximately horizontally from idler roller 260 towards idler roller 265.

As shown in FIG. 3, at idler roller 265, advertising insert ribbon 220 is spaced apart from advertising panel ribbon 215, with advertising insert ribbon 220 being routed above advertising panel ribbon 215. Advertising insert ribbon 220 wraps around a portion of the bottom of idler roller 265 and is routed upwardly towards idler roller 270. A glue head 275 is mounted to the angle bar apparatus above idler roller 265, and advertising panel ribbon 215 is routed above glue head 275 towards idler roller 270.

In one embodiment, glue head 275 is configured to apply a continuous line of glue to the underside of advertising panel ribbon 215. In another embodiment, a glue head or multiple glue heads may be configured to apply more than one continuous line of glue to the underside of advertising panel ribbon 215. In yet another embodiment, appropriate equipment may be used to apply glue in islands, with an appropriate glue formulation being used to obtain the desired tack and peelability of the advertising panel ribbon 215.

After idler roller 265, advertising insert ribbon 220 proceeds upwardly towards idler roller 270, then idler roller 270 causes advertising insert ribbon 220 to be routed downwardly. Advertising panel ribbon 215 is also caused to be routed to idler roller 270 (from idler roller 245) and after advertising panel ribbon 215 has had glue applied to it by glue head 275, it proceeds to idler roller 270. At idler roller 270, advertising panel ribbon 215 is positioned onto advertising insert ribbon 220, and the glue applied by glue head 275 causes advertising panel ribbon 215 to be attached to advertising insert ribbon 220, creating attached ribbons 280.

Attached ribbons 280 proceed away from idler roller 270 to gain driven roller 295. In one embodiment, gain driver roller 295 uses a 4% gain. Gain driven roller 295 routes the attached ribbons to former board 285. As is known, a former board is a triangular shaped piece that folds a ribbon lengthwise as the ribbon passes over the former board. In one embodiment, the former board 285 is at 57.5 degrees. The attached ribbons then proceed to former rollers 290, which complete the folding process for the attached ribbons 280.

In the present embodiment, after the attached ribbons 280 are folded by proceeding through former board 285 and former rollers 290, the attached ribbons are cut by a cutter to produce separate advertising inserts having fastened advertising panels. The separate advertising pieces are then stacked by stacker 150. In other embodiments, the attached ribbons 280 could also be further folded, trimmed, or cut to produce different types of pieces without deviating from the present invention. For example, advertising insert ribbon 220 may be folded to create a multi-page signature before advertising panel ribbon 215 is fastened to the advertising insert ribbon 220 without deviating from the present invention.

Figure 4:
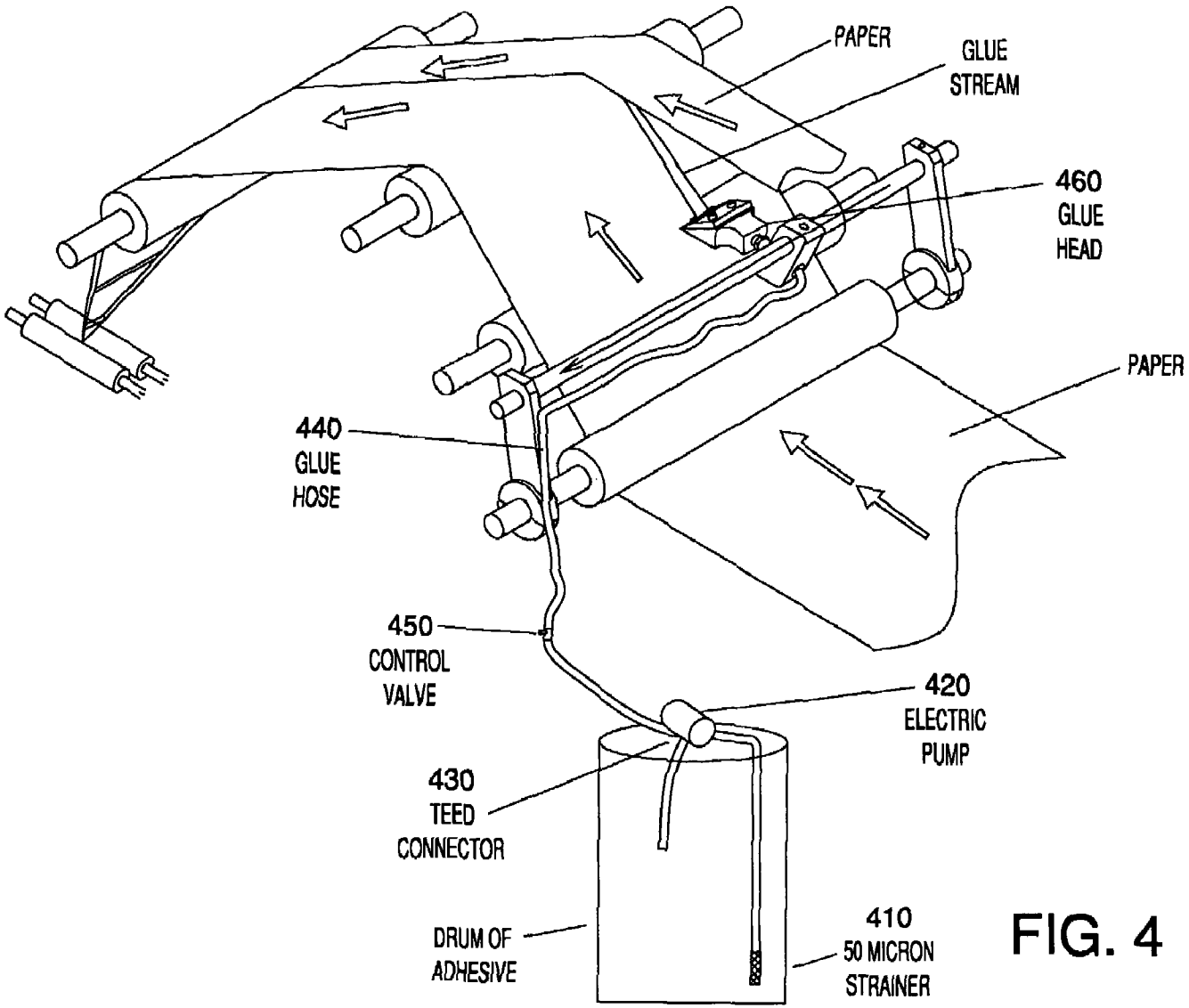
FIG. 4 shows a side perspective view of the glue method and apparatus of the present invention.

FIG. 4 shows a detail of the glue application process. In one embodiment, the glue is a repositionable type glue such as Product Number 3991LC by Craig Adhesives and Coating Co. The repositionable glue preferably holds the ribbons together without fiber-tear when the ribbons are separated, and provides removability and repositionability. Importantly, repositionable glue must have an adequate microsphere concentration to provide removability without fiber-tear. In one embodiment, the microsphere concentration is maintained through the use of an electric pump 420 that is continuously-on while the inline process is running. Having the electric pump 420 continuously-on results in consistent microsphere concentration, but can also result in excess glue being routed to the glue head 275. Accordingly, a Teed-connector 430 at the electric pump is used to allow excess glue to be routed back to the glue drum 400. Use of the continuously-on electric pump 420 and Teed-connector 430 allows the glue to maintain its microsphere count, as use of the control valve to control the flow of glue has been found to result in shearing of microspheres, which reduces the microsphere concentration, which reduces the peelability of the glue and increases the amount of fiber-tear during peeling.

In another embodiment of the present invention, the glue used to fasten the first ribbon to the second ribbon is a "stick once" glue such as Product Number 3991VX by Craig Adhesives and Coating Co. The stick once glue holds the ribbons together without fiber-tear when the ribbons are separated. The stick once glue differs from the repositionable glue in that the stick once glue only provides adhesion one time, so after the ribbons are separated the ribbon to which the glue was applied cannot be repositioned or stuck to another surface. The stick once glue allows the advertising panel to maintain its position on the advertising insert during transport and while the insert is being placed into a newspaper, thus preventing the advertising panel from becoming creased, folded, or misaligned, thus making the insert more attractive to consumers. The stick once glue is applied in the same manner as the repositionable glue, using a continuously-on electric pump and a teed-connector to return excess glue to the glue tank.

Figure 5:
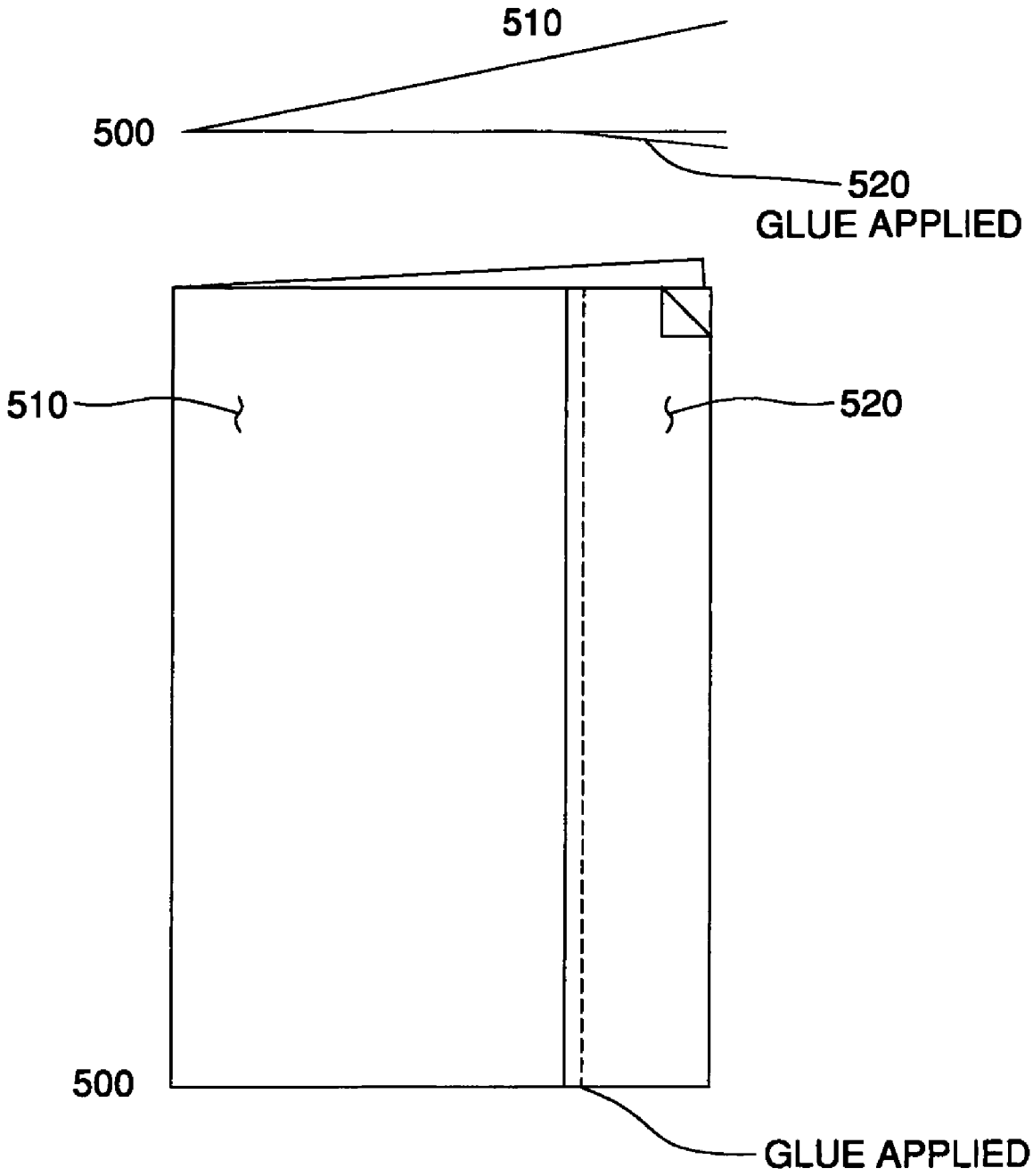
FIG. 5 shows a side perspective view of an insert formed by the present invention.

FIG. 5 shows one embodiment of an insert assembly 500 that may be created by the method and apparatus of the invention. Insert assembly 500 comprises a folded insert 510 with multiple pages, and an advertising panel 520 that is fastened to insert 5 10 using either repositionable or stick once glue. Advertising panel 520 may include perforations (not shown) applied by perforation equipment, such that the advertising panel contains separable coupons or pieces that can be removed from the advertising panel. Both the advertising panel 520 and the advertising insert 510 are generally comprised of various advertising and are generally printed on both sides.

In another embodiment (not shown), the insert assembly may have multiple advertising panels attached to the insert using repositionable or stick once glue. All of the multiple advertising panels may be attached to the insert using one type of glue, either repositionable or stick once glue, or some of the advertising panels may be attached using repositionable glue and some of the panels may be attached using stick once glue. In one embodiment, multiple glue heads may be used to apply glue to the multiple advertising panels or to apply multiple glue strips to a single panel. In this embodiment, the slitter could be configured to slit the web into multiple ribbons. Then those multiple ribbons are routed using appropriate angle bars and rollers, then glue heads apply glue to the multiple ribbons. Then the ribbons are appropriately routed so that they are placed and attached onto the advertising insert. Finally, desired folding is performed and cutting is performed to separate the attached ribbon into individual advertising inserts.

In yet another embodiment (not shown), the advertising panel 520 may be perforated before glue is applied to it by glue head 275. As is known, a perforator (not shown) may be used to perforate a web or a ribbon, and the perforator may be placed in the inline printing assembly after the web 200 has been slit to form the advertising insert ribbon 220 and the advertising panel ribbon 520. The perforator is configured to perforate the advertising panel 215 so that it is separable into separate pieces. The separate pieces may be coupons, business cards, or informational cards, or any type of information piece that a retailer wishes to have in separable form. When the advertising panel is perforated in conjunction with the use of repositionable glue, the individual pieces formed by the perforations may be, for example, coupons that a consumer may separate from the advertising panel and place on a surface such as a refrigerator. When the advertising panel is perforated in conjunction with the use of stick once glue, the individual pieces formed by the perforations may be, for example, coupons that a consumer may separate from the advertising panel and place in a coupon purse. The perforations further increases the interactive nature of the insert, which is already interactive by virtue of having a panel that is removably attached from the insert.

In a variation of the above embodiments, the advertising panel may wrap around both the front and back of the advertising insert, either partially or completely. Alternately, the advertising panel may be a folded gate type panel, which is an extended panel that wraps around an edge of the advertising insert. The wrapped panel may be fastened to the front and/or back of the advertising insert, and multiple glue heads may be used to apply glue to the wrapped advertising panel or to apply multiple glue strips to the panel.

It will be apparent to those skilled in the art that various modifications and variation can be made in the method and apparatus of the present invention without departing from the spirit or scope of the invention. Thus, it is intended that the present invention cover the modifications and variations of this invention provided they come within the scope of the appended claims and their equivalents.

What is claimed is:

1. A method for forming individual insert assemblies using an inline printing press comprising:

feeding a web in lengthwise direction;

forming from the web at least one first ribbon defining an insert;

forming from the web at least one second ribbon defining an advertising panel;

applying repositionable glue to a side of said second ribbon;

attaching said second ribbon to said first ribbon by positioning said side of said second ribbon having repositionable glue onto said first ribbon, thereby forming an attached ribbon; and cutting said attached ribbon to form individual insert assemblies wherein each individual insert assembly includes at least one repositionably attached advertising panel;

wherein applying repositionable glue to said advertising insert comprises continuously-pumping glue from a glue drum to a gluehead that applies the repositionable glue to the second ribbon and routing excess glue generated by the continuous-pumping back to the glue drum using a teed connector, said continuous pumping maintaining a predetermined microsphere concentration for said glue.

2. A method for forming individual insert assemblies using an inline printing press comprising:

feeding a web in a lengthwise direction;

forming from the web at least one first ribbon defining an insert;

forming from the web at least one second ribbon defining an advertising panel;

applying stick once glue to said advertising panel using a gluehead, the applying stick once glue step comprising continuously pumping glue from a glue drum to the gluehead, said continuous pumping maintaining a predetermined microsphere concentration for said glue, the applying stick once glue step further comprising routing excess glue from the continuous-pumping back to the glue drum using a teed connector;

attaching said second ribbon to said first ribbon by positioning said side of said second ribbon having stick once glue onto said first ribbon, thereby forming an attached ribbon; and cutting said attached ribbon to form individual insert assemblies wherein each individual insert assembly includes at least one removably attached advertising panel.

3. The method of claim 2, further comprising perforating the second ribbon thereby creating an advertising panel with separable pieces.

4. The method of claim 2, further comprising folding said attached ribbon in the lengthwise direction of the web prior to cutting said attached ribbon, wherein said attached ribbon is cut perpendicularly to the lengthwise direction of the web such that each individual insert assembly includes an attached advertising panel on one face of the individual insert assembly.

5. The method of claim 2, further comprising folding said attached ribbon perpendicularly to the lengthwise direction of the web, wherein said attached ribbon is cut perpendicularly to the lengthwise direction of the web such that each individual insert assembly includes an attached advertising panel that wraps around the front and back of the insert assembly.

6. The method of claim 2, wherein forming from the web said second ribbon comprises forming the second ribbon wider than the first ribbon so that the second ribbon extends beyond the first ribbon, wherein applying stick once glue to said second ribbon comprises applying stick once glue to the portion of the second ribbon that extends beyond the first ribbon, and wherein attaching said second ribbon to said first ribbon comprises positioning said portion of said second ribbon that has stick once glue onto the first ribbon and further comprises folding said portion of second ribbon not having stick once glue over said first ribbon, thereby creating an attached advertising panel gatefold.

7. The method of claim 2, wherein applying stick once glue further comprises applying at least one continuous strip of stick once glue to said advertising panel.

8. An inline printing press for forming an insert assembly having an advertising insert formed from a first ribbon of a web and an attached advertising panel created from a second ribbon of the web, comprising:

web feeding apparatus for routing a web or ribbons created from the web through the inline printing press in a lengthwise direction;

a printing unit for printing on the web as it is being fed by the web feeding apparatus;

a slitter;

a glue applicator; and a cutter;

wherein the web feeding apparatus causes the web to be routed through the printing unit and the slitter, thereby forming from the web a first ribbon defining an advertising insert and a second ribbon defining an advertising panel;

wherein the web feeding apparatus causes the second ribbon to routed to the glue applicator, which applies repositionable glue to one side of the second ribbon;

wherein the web feeding apparatus causes the side of the second ribbon having repositionable glue to be positioned onto the first ribbon, thereby causing the second ribbon to become attached to the first ribbon and forming an attached ribbon;

wherein the web feeding apparatus causes the attached ribbon to be routed to the cutter, which cuts the attached ribbon to form individual insert assemblies, wherein each individual insert assembly includes at least one repositionably attached advertising panel;

wherein the glue applicator comprises a glue tank, a glue hose, a glue head, and a continuously-on electric pump, wherein the continuously-on electric pump pumps glue to the glue head through the glue hose thereby maintaining a predetermined microsphere concentration for said glue; and wherein the glue applicator further comprises a teed connector for routing away excess glue pumped by the continuously-on electric pump.

9. An inline printing press for forming an insert assembly having an advertising insert formed from a first ribbon of the web and an attached advertising panel created from a second ribbon of the web, comprising:

web feeding apparatus for routing a web or ribbons created from the web through the inline printing press in a lengthwise direction;

at least one printing unit for printing on the web as it is being fed by the web feeding apparatus;

a slitter;

a glue applicator comprising a glue tank, a glue hose, a glue head, and a continuously-on electric pump, wherein the continuously-on electric pump pumps glue to the glue head through the glue hose, the glue applicator further comprising a teed connector for routing away excess glue pumped by the continuously-on electric pump; and a cutter, wherein the web feeding apparatus causes the web to be routed through the printing unit and the slitter, thereby forming from the web a first ribbon defining an advertising insert and a second ribbon defining an advertising panel;

wherein the web feeding apparatus causes the second ribbon to routed to the glue applicator, which applies stick once glue to one side of the second ribbon;

wherein the web feeding apparatus causes the side of the second ribbon having stick once glue to be positioned onto the first ribbon, thereby causing the second ribbon to become attached to the first ribbon by the stick once glue and forming an attached ribbon, and wherein the web feeding apparatus causes the attached ribbon to be routed to the cutter, which cuts the attached ribbon to form individual insert assemblies wherein each individual insert assembly includes at least one releasably attached advertising panel.

10. The apparatus of claim 9, further comprising a perforator for perforating a section of the advertising panel, thereby creating an advertising panel with separable pieces.

11. The apparatus of claim 9, further comprising a folder for folding the attached ribbon in the lengthwise direction of the web before the web is cut by said cutter.

* * * * *